US008011848B2

(12) United States Patent
Sockman et al.

(10) Patent No.: US 8,011,848 B2
(45) Date of Patent: Sep. 6, 2011

(54) QUICK CHANGE ADAPTER FOR MOUNTING BRUSHES

(75) Inventors: John Sockman, Pocono Manor, PA (US); Dave Bennett, Cresco, PA (US)

(73) Assignee: Weiler Corporation, Cresco, PA (US)

( * ) Notice: Subject to any disclaimer, the term of this patent is extended or adjusted under 35 U.S.C. 154(b) by 751 days.

(21) Appl. No.: 12/214,108

(22) Filed: Jun. 16, 2008

(65) Prior Publication Data

US 2009/0311041 A1 Dec. 17, 2009

(51) Int. Cl.
*F16B 7/00* (2006.01)

(52) U.S. Cl. ..... 403/348; 403/325; 403/327; 451/359

(58) Field of Classification Search ..... 403/315–319, 403/325, 327, 348, 349, 353, 322.1, 326, 403/330, 359.5, 359.6, 360, DIG. 4; 16/422; 451/360, 344, 356, 357, 359, 911; 279/93, 279/104, 143; 411/349; 15/28, 230, 97.1, 15/104.16

See application file for complete search history.

(56) References Cited

U.S. PATENT DOCUMENTS

| | | | | | |
|---|---|---|---|---|---|
| 2,471,190 | A * | 5/1949 | Bartelson | 439/332 |
| 2,497,217 | A * | 2/1950 | Hall | 451/342 |
| 2,901,258 | A * | 8/1959 | Brandafi | 279/97 |
| 5,372,464 | A * | 12/1994 | Bureller | 408/72 B |
| 6,126,359 | A * | 10/2000 | Dittrich et al. | 403/349 |
| 2009/0098813 | A1 * | 4/2009 | Chen | 451/360 |

* cited by examiner

*Primary Examiner* — Daniel P. Stodola
*Assistant Examiner* — Eric Chau
(74) *Attorney, Agent, or Firm* — Drinker Biddle & Reath LLP

(57) ABSTRACT

A quick change adapter for removeably mounting a finishing tool to a rotary drive shaft. The quick change adapter includes a shaft hub mount designed to be mounted to a rotary drive shaft, and a tool hub mount designed to hold a finishing tool and to be removably secured to the shaft hub mount. The shaft hub mount includes a shaft sleeve with an annular sleeve ring on it. An annular locking ring is biased against the sleeve ring and includes a locking tab that slides into a locking slot in the sleeve ring. The tool adapter includes a lock sleeve adapted to slide between the annular locking ring and the shaft sleeve. The lock sleeve has a locking finger this slides into a recess slot in the locking slot when the tool adapter mount is engaged with the shaft hub mount.

25 Claims, 5 Drawing Sheets

QUICK CHANGE ADAPTER FOR MOUNTING BRUSHES

FIELD OF THE INVENTION

The invention relates to surface finishing tools and, more particularly, to a quick change adapter for mounting rotationally driven replaceable tools onto a drive spindle.

BACKGROUND OF THE INVENTION

Surface finishing tools are used extensively in the manufacture and repair of products. Many surface finishing tools are designed to be replaceably or interchangeably attached to a drive system. For example, wire brushes, sanding discs and flap discs wear over time and, thus, are designed to be replaceable components. These tools are removeably mounted to a spindle or drive shaft on a drive system.

Generally, the replaceable tool includes a hub that is slipped over the spindle and secured, such as with a set screw. However, mounting and removing the replaceable component can be tedious, and time consuming. In a finishing operation, multiple tools may be replaced over a single work shift. As such, the downtime involved in changing tools greatly adds to the cost of the product. Also, if the tool has been operating for sometime, the worn component may be hot to the touch, making its removal potentially harmful.

A need therefore exists for an improved mounting system that simplifies and expedites the mounting of a replaceable surface finishing component.

SUMMARY OF THE INVENTION

The present invention is directed to a quick change adapter for removeably mounting a finishing tool to a rotary drive shaft. The quick change adapter includes a shaft hub mount designed to be mounted to a rotary drive shaft, and a tool hub mount designed to hold a finishing tool and to be removably secured to the shaft hub mount.

The shaft hub mount includes a shaft sleeve adapted to slide onto the drive shaft. The shaft sleeve has a first end and a second end on the opposite side of the sleeve from the first end. The sleeve includes a main sleeve portion extending with from the first end to a radial flange. The main portion has an outer surface. An annular sleeve ring is located on a radial end of the flange and circumscribes at least a portion of the main portion. The sleeve ring is spaced radially outward from the main portion so as to define a cavity between the outer surface of the main body portion and an inner surface of the sleeve ring.

At least one locking slot is formed in the sleeve ring and extends axially from one end of the sleeve ring to the flange. A recess slot is formed in the sleeve ring and extends circumferentially from at least one side of the locking slot.

An annular locking ring is disposed about a rear portion of the shaft sleeve between the flange and the second end of the sleeve. The locking ring is adapted to slide on the rear portion of the shaft sleeve. The locking ring has at least one locking tab that extends axially away from a front face of the locking ring. The locking tab is adapted to slide axially into the locking slot in the sleeve ring so as to block at least a portion of the recess slot when the locking ring is located adjacent to the flange.

A spring retention plate is attached to the second end of the shaft sleeve and has a front face. At least one compression spring is located between the locking ring and the front face of the spring retention plate and biases the locking ring toward the flange and away from the retention plate.

The tool adapter includes an adapter hub with an outer mounting surface, and a means for removably securing a finishing tool to the adapter hub, such as a nut and flange.

A lock sleeve extends axially from the adapter hub and has an inner bore formed in a rear end portion of the lock sleeve. The lock sleeve slides over a portion of the outer surface of the main portion of the shaft sleeve so that when the tool adapter mount is slid into the shaft hub mount, the rear end portion of the lock sleeve is located in the cavity between the sleeve ring and the outer surface of the main portion. The lock sleeve has at least one locking finger projecting radially outward from an outer surface of the lock sleeve. The locking finger is adapted to slide into the locking slot and the recess slot on the sleeve ring when the tool adapter mount is slid into engagement with the shaft hub mount.

In one embodiment there are a plurality of locking slots formed in the sleeve ring spaced equally about the circumference of the sleeve ring, and the lock sleeve has a plurality of locking fingers spaced circumferentially about the outer surface with spacings that are substantially the same as the spacings of the locking slots.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1:
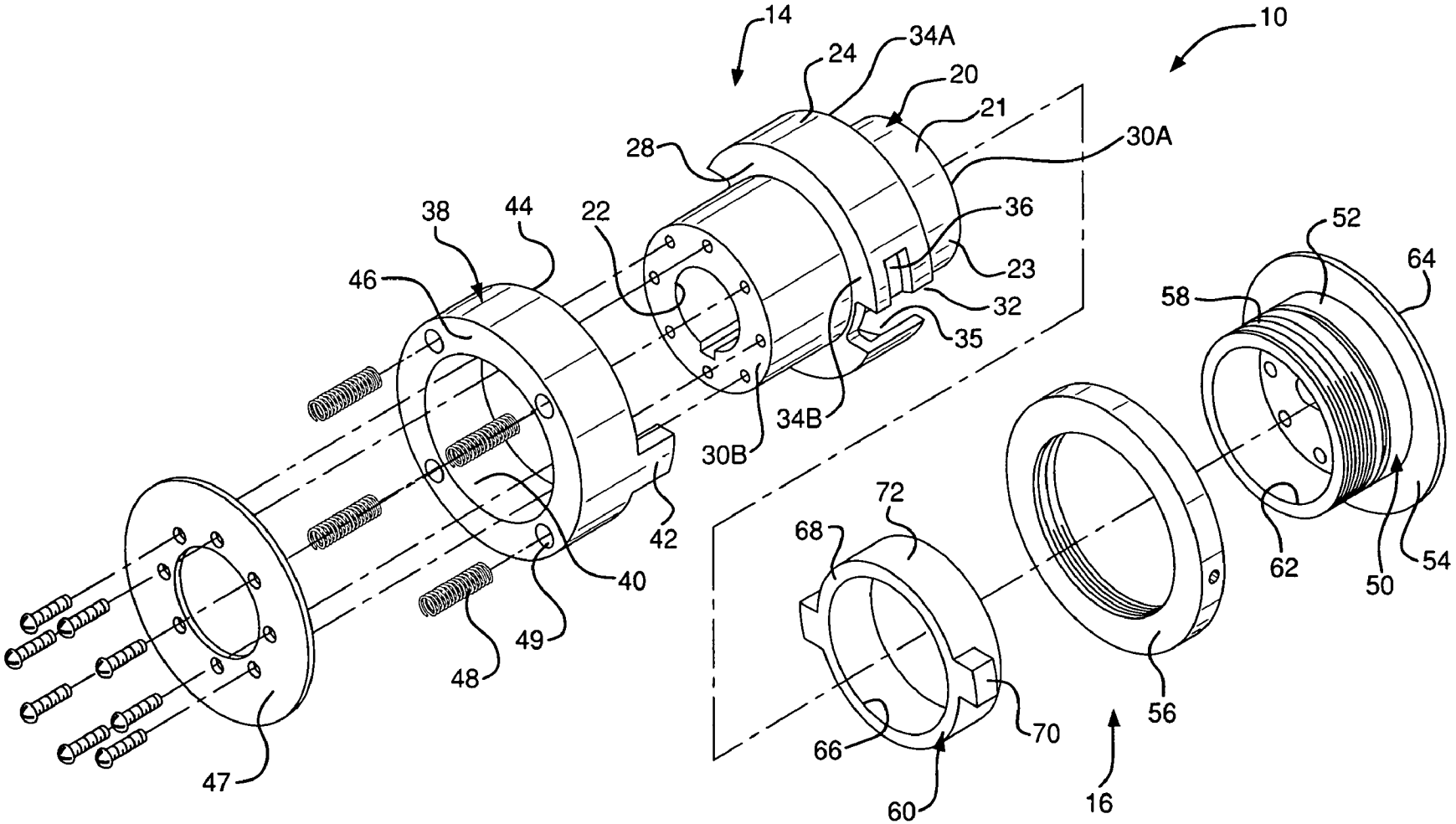
FIG. 1 is an exploded isometric view of a quick change adapter for a finishing tool according to the present invention.
Figure 2:
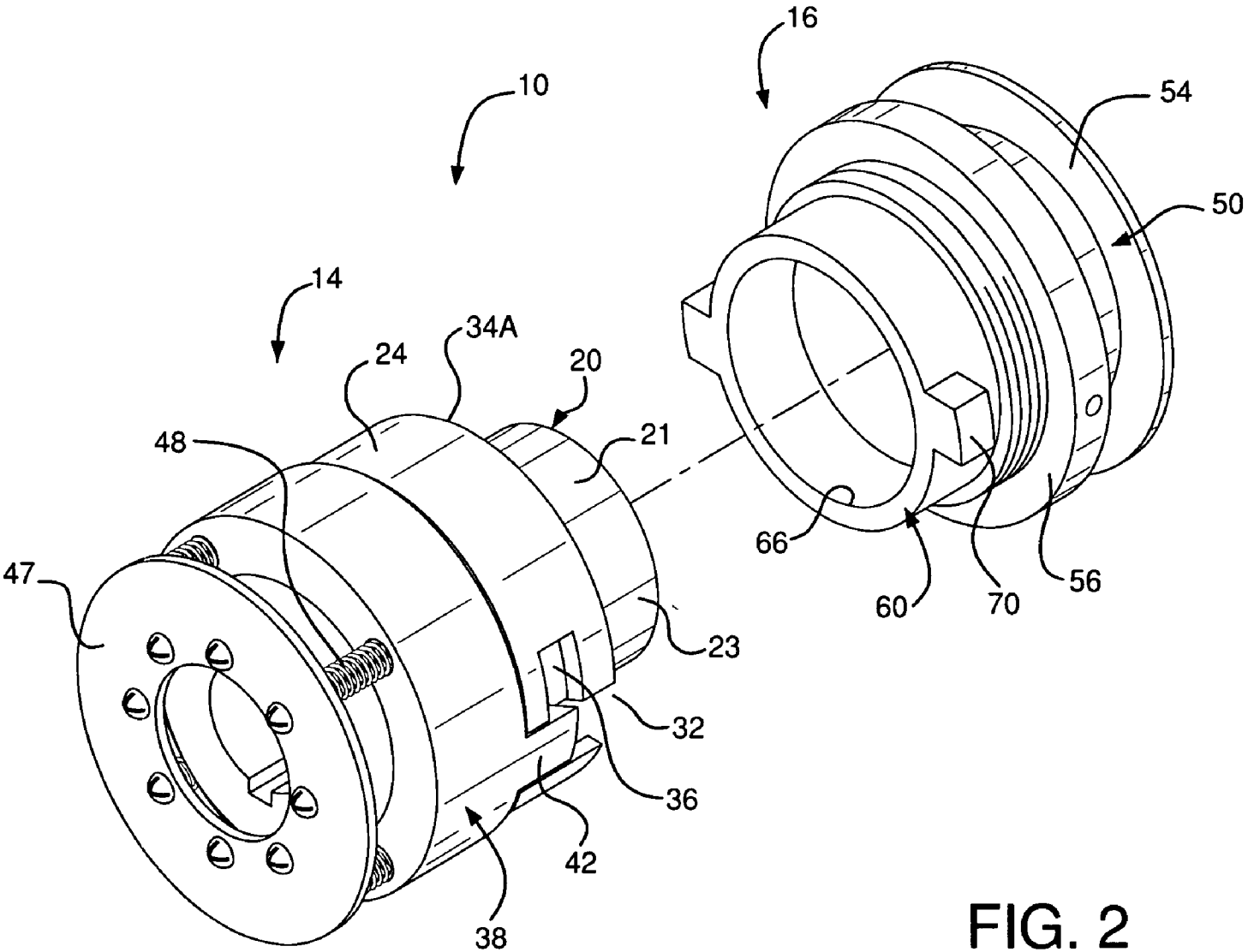
FIG. 2 is an isometric view of the two assembled mounting portions of the quick change adapter of FIG. 1 showing the mount in a disengaged position.
Figure 3:
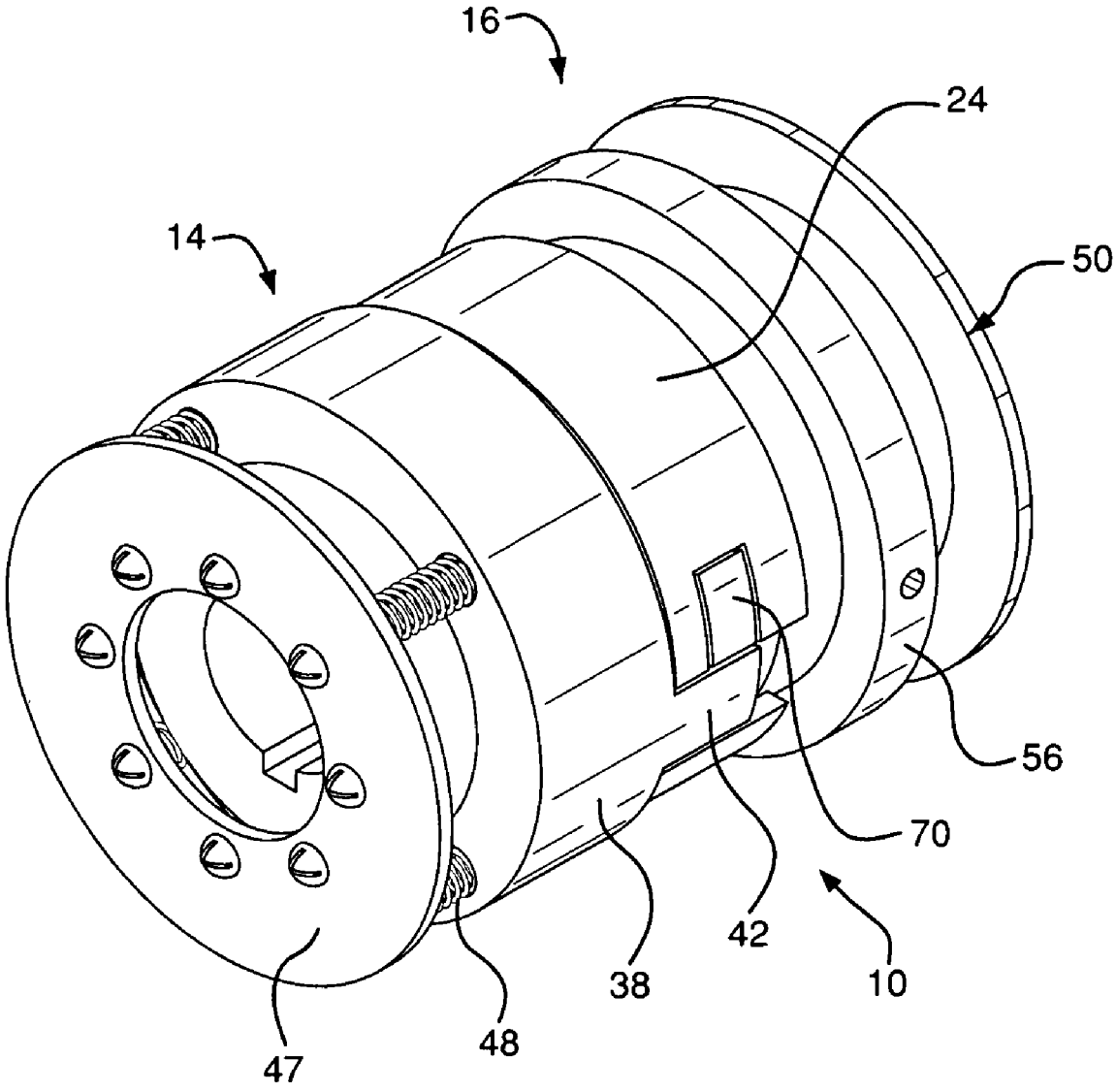
FIG. 3 is an isometric view of the quick change adapter of FIG. 1 showing the mount in an engaged or locked position.
Figure 4A:
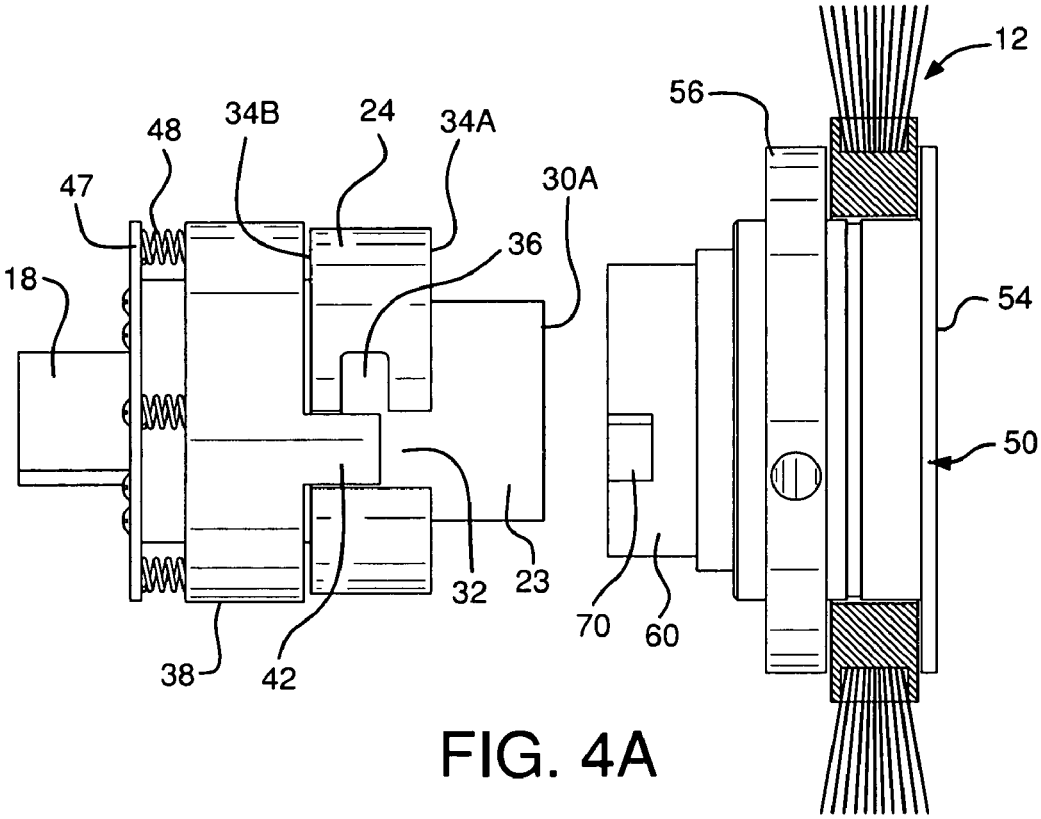
FIGS. 4A-4D are side views of the quick change adapter of FIG. 1 showing four stages for engaging the two component mounts.
Figure 4B:
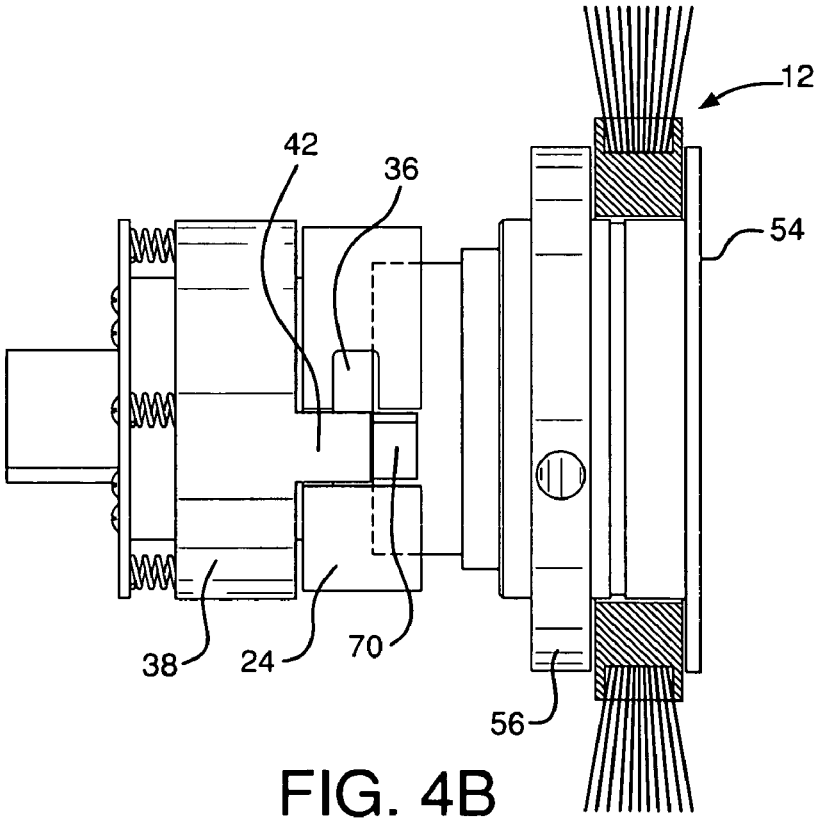
Figure 4C:
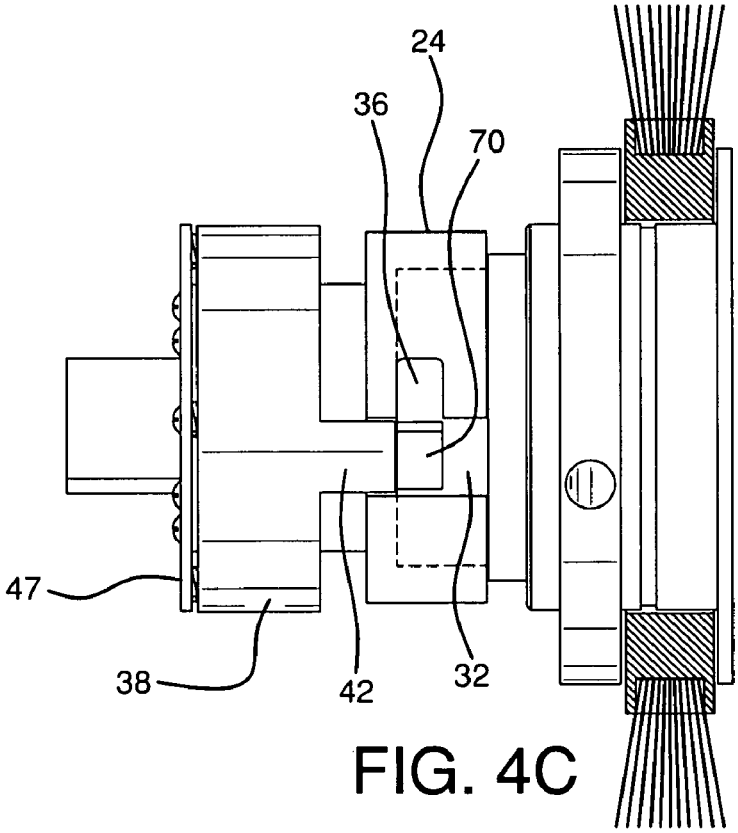
Figure 4D:
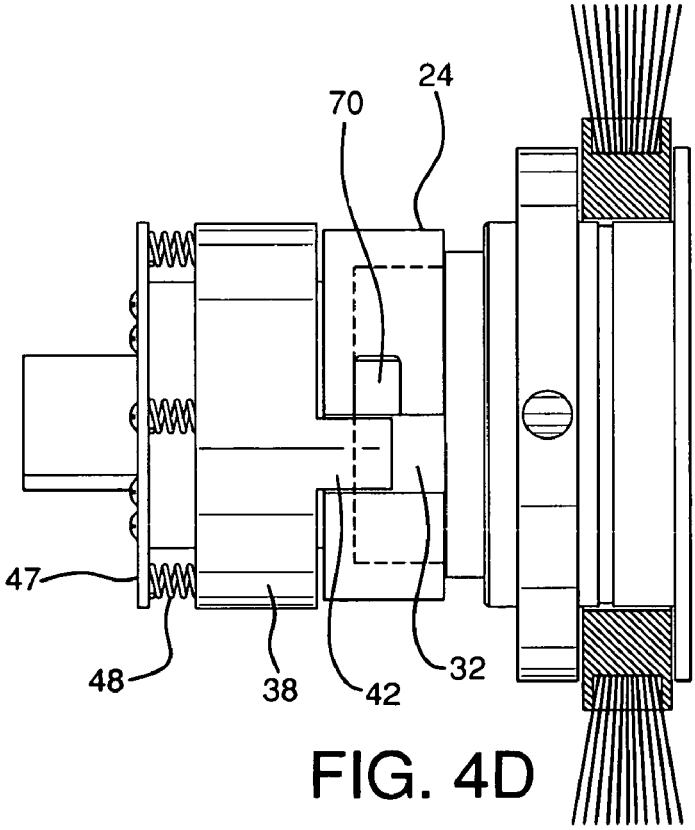

Referring now to the drawings, wherein like reference numerals illustrate corresponding or similar elements throughout the several views, FIGS. 1-4D illustrate a preferred embodiment of a quick change adapter 10 according to the present invention for mounting a finishing tool 12, such as a brush or flap disc. The quick change adapter 10 includes a shaft hub mount 14 designed to attach to a drive shaft or spindle 18 or a power driven tool, and a tool adapter mount 16 onto which the tool 12 is attached.

The shaft hub mount 14 includes a shaft sleeve 20 that has a central bore 22 extending therethrough. The central bore 22 is shaped to slide over the drive shaft 18. Preferably the drive shaft 18 has a cylindrically shape, in which case the central bore is also cylindrical in shape. However, the present invention can be configured to work on any shaft shape, including square or D-shaped drive shafts. Also, the shaft may include a locking mechanism to prevent rotation of the shaft sleeve relative to the shaft, such as a key or splines that engage with a mating keyway or splines, respectively, formed in the shaft sleeve 20 thereby rotationally locking the two components together.

The shaft sleeve 20 includes an annular sleeve ring 24 preferably formed integral with the shaft sleeve 20 and spaced radially outward from a main portion 21 of the shaft sleeve 20 so as to define a cavity 35 between the outer surface 23 of the main portion 21 and an inner surface of sleeve ring 24. In the illustrated embodiment, the sleeve ring 24 is attached to the main portion 21 of the shaft sleeve 20 through a radially extending flange 28. The sleeve ring 24 and flange 28 are preferably located on the shaft sleeve 20 such that the ends 30A, 30B of the shaft sleeve are on either side of the sleeve ring 24 and flange 28. This design provides a stable mounting for the sleeve ring on the shaft 18. It is, however, contemplated that the sleeve ring 24 and flange 28 can be close to or at either end of the shaft sleeve 20.

At least one and preferably at least two locking slots 32 are formed in the sleeve ring. The locking slots 32 extend axially from one end 34A of the sleeve ring to the other end 34B. If there is more than one locking slot 32, the locking slots are preferably spaced equally about the circumference of the sleeve ring 24. Each locking slot 32 includes a recess slot 36 is formed in the sleeve ring and extending circumferentially from one side of the locking slot 32 so that the combination of the each locking slot 32 and recess slot 36 forms a T-shaped opening in the sleeve ring. As will be explained in more detail below, the locking slot 32 and the recess slot 36 form part of a bayonet-type locking attachment for engaging the tool adapter mount 16 with the shaft hub mount 14.

The shaft hub mount 14 also includes an annular locking ring 38. The locking ring 38 has an inside surface 40 that has a diameter which is slightly larger than the diameter of the portion of the shaft sleeve 20 between the flange 28 and the end 30B. Thus, the sliding ring 38 is designed to slide along the shaft sleeve 20. The locking ring 38 includes at least one locking tab 42 that extends axially out from a front face 44 of the locking ring 38. The locking tab 42 is sized and shaped to fit within the locking slot 32. In one preferred embodiment, there are the same number of locking tabs 42 as there are locking slots 32. However, it is not required that there be the same number of locking tabs as locking slots. As should be apparent, the sliding of the locking ring 38 toward and away from the sleeve ring causes the locking tab 42 to move in and out of the locking slot 32. The locking tab 42 has an axial length that is configured to cause the locking tab 42 to extend far enough into the locking slot so as to block at least a portion and more preferably substantially all of the recess slot 36. As such, when the locking ring is positioned against or close to the flange 28, the locking tab(s) block entry into or egress from the recess slot(s) 36 from the locking slot 32. This position corresponds to the locked position of the shaft hub mount 14.

In the illustrated embodiment, the axial length of the locking ring 38 is less than the length of the portion of the shaft sleeve 20 between the flange 28 and the rear end 30B. Thus, when mounted on the shaft sleeve 30 and against the flange 28, the shaft sleeve 30 projects past the rear face 46.

A spring retention plate 47 is attached to the rear end 30B of the shaft sleeve 20, such as with screws, bolts or other conventional fastening mechanism.

At least one compression spring 48 is located between the locking ring 38 and the spring retention plate 47 for biasing the locking ring 38 away from the retention plate 47. Preferably there are a plurality of compression springs 48. In the illustrated embodiment, in order to secure the springs 48 in place, there are a corresponding plurality of spring seats 49 formed in the rear face 46 of the locking ring 38. A spring 48 is located in each seat 49 and extends out from the seat past the rear face 46 of the locking ring 38 and into the front face of the spring retention plate 47. Since the spring retention plate 47 is secured to the shaft sleeve 20, it functions as a fixed reaction surface, allowing the compression spring 48 to bias the locking ring 38 toward the flange 28, and, thus, into the locked position of the shaft hub mount 14.

While the embodiment illustrated includes four springs, it is also contemplated that a single coil spring could be positioned around the shaft sleeve 20 between the rear face 46 of the locking ring 38 and the retention plate 47.

The tool adapter mount 16 includes an adapter hub 50 with an outer mounting surface 52 and an end flange 54. The outer mounting surface is preferably cylindrical in shape and sized to fit within a mounting hole of a finishing tool. However it is contemplated that the mounting surface 52 can have any desired shape, preferably complementary to the shape of the mounting hole on the finishing tool. The end flange 54 extends radially outward from the mounting surface 52 and has a diametric dimension that is larger than the mounting hole on a finishing tool so as to prevent the finishing tool from sliding off the end of the adapter hub 50.

A retaining nut 56 is removeably engaged to the adapter hub 50. More particularly, the mounting surface 52 preferably includes threads 58 formed on a portion of the surface that engage with mating threads on the inside diameter of the nut 56. The threads permit the retaining nut to be threaded onto and removed from the adapter hub. In use, a finishing tool, such as a circular wire brush, is slid onto the adapter hub 50 until it abuts the end flange 54. The nut is treaded onto the threads 58 until it abuts the tool, thereby securing the tool to the adapter hub 50. Other forms of attachment could be substituted for the threads, such as a set screw, pins, etc., and would be apparent to those skilled in the art. Also, it is contemplated that the finishing tool could have threads formed on its mounting hole and could be threaded directly onto the adapter hub, thus eliminating the need for a retaining nut.

A lock sleeve 60 is attached to the adapter hub 50 and extends axially past the end of the hub. In more preferred embodiment shown in the figures, a portion of the lock sleeve 60 is seated within a recess 62 formed in the adapter hub 50 radially inward from the mounting surface 52 and is attached to a front face 64 of the adapter hub through one or more fasteners. While the lock sleeve is described as a separate component from the adapter hub, it is also contemplated that the lock sleeve can be formed integral to the adapter hub.

The lock sleeve 60 has an inner bore 66 that is designed to slide over the outer surface 23 of the main portion 21 of the shaft sleeve 20 located axially forward of the flange 28. Thus, when the tool adapter mount 16 is slid into the shaft hub mount 14, the rear end portion 68 of the lock sleeve 60 is located between the sleeve ring 24 and the main portion 21 of the shaft sleeve 20.

The lock sleeve 60 includes at least one, and more particularly, a plurality of locking fingers 70 that project radially outward from the outer surface 72 of the lock sleeve 60 at or near the rear end portion 68. The locking fingers 72 are preferably spaced circumferentially about the outer surface 72 with spacings that are substantially the same as the spacings of the locking slots 32 such that when the tool adapter mount 16 is slid into engagement with the shaft hub mount 14, each locking finger 70 slides into a corresponding locking slot 32.

The operation of the adapter will now be described. When it is desired to attach a circular finishing tool, such as wire brush, to a drive system, a wire brush is attached to the tool adapter mount 16 as described above (e.g., slid onto the adapter hub 50 and secured with the retainer nut 56.) The shaft adapter hub 14 is slid onto the drive shaft 18 and secured to it, such as with a set screw. The lock sleeve 60 of the tool adapter mount is slid over the shaft sleeve 20 such that the locking fingers 70 slide within the locking slots 32 until the locking fingers 70 contact the lock tabs 42. At this point, the locking tabs 42 are blocking the recess slot 36. Further axial displacement of the tool adapter mount 16 toward the shaft adapter mount 14 causes the locking fingers 70 to press into the locking tabs 42. Axial movement of the locking tabs 42 is inhibited by the compression spring 48. When sufficient force is applied to the tool adapter mount 16 to overcome the spring force, the locking fingers will force the locking ring 38 to slide axially on the shaft sleeve 20 until the locking tabs 42 are no longer blocking the recess slots 36. This corresponds to the unlocked position of the shaft hub mount 14. The tool adapter mount 16 is then rotated about the longitudinal axis of the shaft 18 (clockwise in the embodiment illustrated) causing the locking fingers 70 to slide into the recess slots 36. Once the fingers are in the recesses, the spring force of the compression spring 48 urges the locking ring 38 to slide back against the flange 28 of the shaft sleeve 20 causing the tabs to block the recess slots 36. Accordingly, the locking fingers are secured within the recess slots, thereby locking the tool adapter mount 16 to the shaft adapter mount 14.

To remove the tool adapter, locking ring 38 is slid rearward causing the springs to compress and the lock tabs 42 to retract from blocking recess slot 36. The tool adapter mount 16 is rotated so that locking fingers 70 disengage from slot 32. The tool adapter mount 16 can then be removed by sliding the shaft adapter hub 14 off of sleeve 21.

It should be noted that the tool adapter mount 16 in the present invention is designed such that the lock sleeve 60 is universal and can be mounted with different sizes of adapter hubs 50 and retaining nuts 56. As such, the adapter hubs and retaining nuts can be designed for specific brush arbor hole sizes. Also, the adapter hub 50 and retaining nut 56 are configured such that the brushes can be easily removed and mounted without disconnecting the lock sleeve 60.

The sleeve ring may include a secondary recess or ledge adjacent to the flange and extending radially from the locking slot. The secondary recess can be used as a retention mechanism for holding the locking ring in a unlocked position. With the locking ring in its unlocked position, the user rotates the locking ring relative to the sleeve ring such that the locking tab is out of alignment with the locking slot and can rest against the secondary recess. This maintains the shaft hub mount unlocked from the tool hub mount until the locking ring is rotated back so that the locking tab can slide into the locking slot.

While the invention has been disclosed with reference to certain preferred embodiments, numerous modifications, alterations, and changes to the described embodiments are possible without departing from the scope of the invention, as defined in the appended claims and equivalents thereof. Accordingly, it is intended that the invention not be limited to the described embodiments, but that it have the full scope defined by the language of the following claims.

The invention claimed is:

1. A quick change adapter for removeably mounting a finishing tool to a rotary drive shaft, the quick change adapter comprising:

a shaft hub mount adapted to attach to a drive shaft, the shaft hub mount including:

a shaft sleeve adapted to slide onto the drive shaft, the shaft sleeve having a first end, and a second end on the opposite axial side of the sleeve from the first end, the sleeve including a main portion extending from the first end to a radial flange, the main portion having an outer surface, an annular sleeve ring formed on a radial end of the flange and circumscribing at least a portion of the main portion, the sleeve ring being spaced radially outward from the main portion so as to define a cavity between the outer surface of the main portion and an inner surface of the sleeve ring, at least one locking slot is formed in the sleeve ring and extending axially from one end of the sleeve ring to the flange, and a recess slot formed in the sleeve ring and extending circumferentially from at least one side of the locking slot, an annular locking ring disposed about a rear portion of the shaft sleeve between the flange and the second end, the locking ring adapted to slide on the rear portion of the shaft sleeve, the locking ring having at least one locking tab that extends axially away from a front face of the locking ring, the locking tab adapted to slide axially into the locking slot in the sleeve ring so as to block at least a portion of the recess slot when the locking ring is located adjacent to the flange, a spring retention plate attached to the second end of the shaft sleeve, the retention plate having a front face, and at least one compression spring located between the locking ring and the front face of the spring retention plate for biasing the locking ring toward the flange and away from the retention plate; and a tool adapter mount adapted to removably receive a finishing tool, the tool adapter mount including:

an adapter hub with an outer mounting surface, means for removably securing a finishing tool to the adapter hub, and a lock sleeve extends axially from the adapter hub, the lock sleeve having an inner bore formed in a rear end portion of the lock sleeve and sized to slide over the outer surface of the main portion of the shaft sleeve so that when the tool adapter mount is slid into the shaft hub mount, the rear end portion of the lock sleeve is located in the cavity between the sleeve ring and the outer surface of the main portion, the lock sleeve having at least one locking finger projecting radially outward from an outer surface of the lock sleeve, the locking finger adapted to slide into the at least one locking slot and the recess slot on the sleeve ring when the tool adapter mount is slid into engagement with the shaft hub mount.

2. A quick change adapter according to claim 1 wherein there are a plurality of locking slots formed in the sleeve ring, the locking slots being spaced equally about the circumference of the sleeve ring.

3. A quick change adapter according to claim 2 wherein the lock sleeve has a plurality of locking fingers spaced circumferentially about the outer surface with spacings that are substantially the same as the spacings of the locking slots.

4. A quick change adapter according to claim 1 wherein a portion of the lock sleeve is seated within a recess formed in the adapter hub radially inward from the mounting surface.

5. A quick change adapter according to claim 1 wherein the lock sleeve is formed integral with the adapter hub.

6. A quick change adapter according to claim 1 wherein the means for removably securing a finishing tool to the adapter hub includes a removable nut that is threaded onto the mounting surface and an end flange extending radially outward from the outer mounting surface of the adapter hub at an axially outer end and which prevents a finishing tool from sliding off the end of the adapter hub.

7. A quick change adapter according to claim 1 wherein there are a plurality of compression springs spaced about the shaft sleeve.

8. A quick change adapter according to claim 1 wherein the locking ring includes at least one spring seat formed in a rear face of the locking ring and wherein an end of the compression spring sits within the spring seat.

9. A quick change adapter according to claim 1 wherein the flange is located on the shaft sleeve such that the opposite ends of the shaft sleeve are located on either side of the flange.

10. A quick change adapter according to claim 1 wherein the shaft sleeve includes a keyway for mating with a key on the shaft to rotatably lock the shaft sleeve onto the shaft.

11. A quick change adapter according to claim 1 wherein the axial length of the locking ring is less than the length of the rear portion of the shaft sleeve such that the shaft sleeve projects past a rear face of the locking ring.

12. A quick change adapter for removeably mounting a finishing tool to a rotary drive shaft, the quick change adapter comprising:

a shaft hub mount adapted to attach to a drive shaft, the shaft hub mount including:

a shaft sleeve with a central bore extending therethrough for sliding onto the drive shaft, the shaft sleeve having a first end, a second end, and a main portion with an outer surface, the shaft sleeve including an annular sleeve ring spaced radially outward from the main portion so as to define a cavity between the outer surface of the main portion and an inner surface of the sleeve ring, the sleeve ring being attached to the main portion through a radially extending flange, at least one locking slot is formed in the sleeve ring and extends axially from one end of the sleeve ring to another end, a recess slot is formed in the sleeve ring and extends circumferentially from at least one side of the locking slot, an annular locking ring disposed about a rear portion of the shaft sleeve between the flange and the second end, the locking ring adapted to slide on the rear portion of the shaft sleeve, the locking ring having at least one locking tab that extends axially away from a front face of the locking ring, the locking tab adapted to removeably slide within the locking slot in the sleeve ring, the locking tab adapted to block at least a portion of the recess slot when the locking ring is located adjacent to the flange, a spring retention plate is attached to the second end of the shaft sleeve, the retention plate having a front face, and at least one compression spring located between the locking ring and the front face of the spring retention plate for biasing the locking ring away from the retention plate; and a tool adapter mount adapted to removably receive a finishing tool, the tool adapter mount including:

an adapter hub with an outer mounting surface and an end flange, the outer mounting surface having a size adapted to fit within a mounting hole of a finishing tool, a retaining nut is removeably engaged to the adapter hub for securing a tool to the adapter hub, and a lock sleeve extends axially from the adapter hub, the lock sleeve having an inner bore formed in a rear end portion of the lock sleeve and sized to slide over the outer surface of the main portion of the shaft sleeve so that when the tool adapter mount is slid into the shaft hub mount, the rear end portion of the lock sleeve is located in the cavity between the sleeve ring and the outer surface of the shaft sleeve, the lock sleeve having at least one locking finger projecting radially outward from an outer surface of the lock sleeve, the locking finger adapted to slide into a corresponding locking slot in the sleeve ring when the tool adapter mount is slid into engagement with the shaft hub mount.

13. A quick change adapter according to claim 12 wherein there are a plurality of locking slots formed in the sleeve ring, the locking slots being spaced equally about the circumference of the sleeve ring.

14. A quick change adapter according to claim 13 wherein the lock sleeve has a plurality of locking fingers spaced circumferentially about the outer surface with spacings that are substantially the same as the spacings of the locking slots.

15. A quick change adapter according to claim 14 wherein there are same number of locking tabs as there are locking slots.

16. A quick change adapter according to claim 12 wherein a portion of the lock sleeve is seated within a recess formed in the adapter hub radially inward from the mounting surface.

17. A quick change adapter according to claim 12 wherein the lock sleeve is formed integral with the adapter hub.

18. A quick change adapter according to claim 12 wherein the mounting surface includes threads formed on a portion of the surface that engage with mating threads on the inside diameter of the retaining nut.

19. A quick change adapter according to claim 12 wherein the end flange extends radially outward from the outer mounting surface of the adapter hub and is adapted to prevent a finishing tool from sliding off an end of the adapter hub.

20. A quick change adapter according to claim 12 wherein there are a plurality of compression springs spaced about the shaft sleeve.

21. A quick change adapter according to claim 12 wherein the locking ring includes at least one spring seat formed in a rear face of the locking ring and wherein an end of the compression spring sits within the spring seat.

22. A quick change adapter according to claim 12 wherein the sleeve ring and flange are located on the shaft sleeve such that opposite ends of the shaft sleeve are located on either side of the sleeve ring and flange.

23. A quick change adapter according to claim 12 wherein the shaft sleeve includes a keyway for mating with a key on the shaft to rotatably lock the shaft sleeve onto the shaft.

24. A quick change adapter according to claim 12 wherein the axial length of the locking ring is less than the length of the rear portion of the shaft sleeve such that the shaft sleeve projects past a rear face of the locking ring.

25. A quick change adapter for removeably mounting a finishing tool to a rotary drive shaft, the quick change adapter comprising:

a shaft hub mount adapted to attach to a drive shaft, the shaft hub mount including:

a shaft sleeve having a first end, and a second end on the opposite axial side of the sleeve from the first end, a main portion of the sleeve extending from the first end to a radial flange, an annular sleeve ring circumscribes at least a portion of the main portion and is spaced radially outward from an outer surface of the main portion so as to define a cavity between the outer surface and an inner surface of the sleeve ring, at least one locking slot is formed in the sleeve ring and extends axially through the sleeve ring, and a recess slot is formed in the sleeve ring and extends circumferentially from at least one side of the locking slot, a locking ring disposed about a rear portion of the shaft sleeve between the flange and the second end, the locking ring adapted to slide on the rear portion of the shaft sleeve, the locking ring having at least one locking tab that extends axially away from a front face of the locking ring and is adapted to slide axially into the locking slot in the sleeve ring so as to block at least a portion of the recess slot when the locking ring is located adjacent to the flange, and at least one compression spring for biasing the locking ring toward the flange; and a tool adapter mount adapted to removably receive a finishing tool, the tool adapter mount including:

an adapter hub with an outer mounting surface for removably receiving a finishing tool, and a lock sleeve extending axially from the adapter hub and configured to slide over a portion of the outer surface of the main portion of the shaft sleeve so that when the tool adapter mount is engaged with the shaft hub mount, a portion of the lock sleeve is located in the cavity between the sleeve ring and the outer surface of the main portion, the lock sleeve having at least one locking finger projecting radially outward from an outer surface of the lock sleeve, the locking finger adapted to slide into the locking slot and the recess slot on the sleeve ring when the tool adapter mount is slid into engagement with the shaft hub mount.

* * * * *